US009162466B2

(12) United States Patent
Nagashima et al.

(10) Patent No.: US 9,162,466 B2
(45) Date of Patent: Oct. 20, 2015

(54) LIQUID HOUSING BODY RECYCLING METHOD, AND LIQUID HOUSING CONTAINER

(71) Applicant: SEIKO EPSON CORPORATION, Tokyo (JP)

(72) Inventors: Takumi Nagashima, Nagano (JP); Taku Ishizawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/504,661

(22) Filed: Oct. 2, 2014

(65) Prior Publication Data

US 2015/0097902 A1 Apr. 9, 2015

(30) Foreign Application Priority Data

Oct. 7, 2013 (JP) ..... 2013-209935

(51) Int. Cl.
*B41J 2/175* (2006.01)

(52) U.S. Cl.
CPC ..... *B41J 2/17506* (2013.01)

(58) Field of Classification Search
CPC .... B41J 2/17563; B41J 2/175; B41J 2/17513; B41J 2/17556; B41J 2/17523; B41J 2202/07; B41J 2/17506; B41J 2/19
USPC ..... 347/84–86, 92, 93
See application file for complete search history.

(56) References Cited

U.S. PATENT DOCUMENTS 6,652,083 B2 * 11/2003 Ison et al. ..... 347/93
2012/0050429 A1 * 3/2012 Kurobe ..... 347/93

FOREIGN PATENT DOCUMENTS

JP 2004-358802 A 12/2004
JP 2011-148221 A 8/2011

* cited by examiner

*Primary Examiner* — Thinh Nguyen
(74) *Attorney, Agent, or Firm* — Global IP Counselors, LLP

(57) ABSTRACT

A liquid housing body recycling method is provided for a liquid housing body that includes a liquid housing unit that is configured to house liquid, a supply member with a supply port that is configured to be connected to a liquid supply tube of a liquid consuming device, and a filter through which the liquid is configured to pass, with the liquid inside the liquid housing unit being supplied to the liquid consuming device via the supply port by passing through the filter. The liquid housing body recycling method includes forming an opening part on the liquid housing unit at a position outside an area facing opposite the filter on the liquid housing unit, injecting the liquid from the opening part of the liquid housing unit on which the opening part has been formed, and sealing the opening part.

6 Claims, 10 Drawing Sheets

LIQUID HOUSING BODY RECYCLING METHOD, AND LIQUID HOUSING CONTAINER

CROSS-REFERENCE TO RELATED APPLICATIONS

This application claims priority to Japanese Patent Application No. 2013-209935 filed on Oct. 7, 2013. The entire disclosure of Japanese Patent Application No. 2013-209935 is hereby incorporated herein by reference.

BACKGROUND

1. Technical Field

The present invention relates to a liquid housing body recycling method for a liquid housing body capable of housing liquid, and to a liquid housing container.

2. Related Art

From the past, inkjet printers have been known as an example of a liquid consuming device that sprays and consumes a liquid (ink or the like). A liquid housing container (ink cartridge or the like) with a liquid housing body (ink bag or the like) having a liquid housing unit in which liquid is housed equipped inside a case member is mounted in this kind of printer, and liquid is supplied from the liquid housing container mounted in this way.

A supply port that flows out the liquid housed in the liquid housing unit is provided on a liquid housing body of this kind of liquid housing container. In a state with the liquid housing body housed inside the liquid housing container, this supply port is exposed inside the case member. Then, when the liquid housing container is mounted in a mounting unit of the printer, this supply port is connected to be able to supply liquid to a liquid supply tube (e.g., a supply needle) provided in the printer. Alternatively, there are also cases when the liquid is supplied to the liquid supply tube from the supply port by connecting the supply port and the liquid supply tube with a tube that is a liquid flow path.

Also known are liquid housing containers for which arranged inside the liquid housing unit is a filter that removes foreign matter from within the liquid flowed out from the supply port by the liquid passing through the inside of the liquid housing unit (see JP-A-2011-148221 (Patent Document 1), for example).

Furthermore, there have been proposals to recycle liquid housing containers for which supplying of liquid to the printer has become difficult due to the liquid inside the housing unit decreasing with supplying of liquid to the printer, by again injecting liquid inside the liquid housing unit of the liquid housing body housed inside that liquid housing container (see JP-A-2004-358802 (Patent Document 2), for example).

SUMMARY

However, with a liquid housing container equipped with a liquid housing body for which a filter is arranged inside a liquid housing unit, so that foreign matter is not included in the liquid supplied via a supply port, the liquid inside the liquid housing unit is flowed to the supply port after passing through a filter arranged inside the liquid housing unit. Because of this, when recycling the liquid housing body, it is important to make sure the filter is not damaged. However, there has not been proposed from the past a constitution for which liquid is injected without damaging the filter with a liquid housing body for which the filter is arranged inside the liquid housing unit.

This circumstance is generally common to a liquid housing container equipped with a liquid housing body for which a filter is arranged inside the liquid housing unit which is capable of housing liquid, when again injecting liquid into the liquid housing unit.

The present invention is conceived in light of these circumstances, and an advantage is to provide a liquid housing body recycling method with which it is possible to recycle the liquid housing body while suppressing damage to the filter, and a liquid housing container.

Following, we will note the means for solving the problems noted above, and the effects thereof.

The liquid housing body recycling method to address the problems noted above is a liquid housing body recycling method for a liquid housing body that includes a liquid housing unit that is configured to house liquid, a supply member with a supply port that is configured to be connected to a liquid supply tube of a liquid consuming device, and a filter through which the liquid is configured to pass, with the liquid inside the liquid housing unit being supplied to the liquid consuming device via the supply port by passing through the filter. The liquid housing body recycling method includes an opening forming step of forming an opening part on the liquid housing unit at a position outside an area facing opposite the filter on the liquid housing unit, an injection step of injecting the liquid from the opening part of the liquid housing unit on which the opening has been formed, and a sealing step of sealing the opening part.

With this method, the opening part for injecting liquid inside the liquid housing unit of the liquid housing body during recycling is formed outside the area facing the filter with the liquid housing unit, so it is possible to recycle the liquid housing body while suppressing damage to the filter that the liquid housing body has.

With the liquid housing body recycling method noted above, it is preferable that the liquid housing unit is formed of a sheet member, the filter is in sheet form, and in a state with the liquid not housed inside the liquid housing unit, a sheet surface of the filter is arranged inside the liquid housing unit in an orientation extending along a sheet surface of the liquid housing unit.

With this method, in a state when the liquid is not housed in the liquid housing unit, it is possible to easily confirm the area outside the area facing the filter with the liquid housing unit, specifically, the area for which it is possible to do opening forming of the opening part, so at the opening forming step, it is possible to form the opening part while having a high probability of suppressing damage to the filter.

With the liquid housing body recycling method noted above, it is preferable that the liquid housing body further includes a filter member to which the filter is adhered on one surface side and is disposed inside the liquid housing unit, the liquid housing unit have a first sheet member facing the filter adhered to the filter member, and a second sheet member that does not face the filter, and the first sheet member is arranged in parallel to the filter in a state with the liquid not housed inside the liquid housing unit.

With this method, it is easy to visually confirm the area for which opening formation of the opening part is possible outside the area facing the filter on the first sheet member, so with the opening forming step, it is possible to easily form the opening part while suppressing damage to the filter.

With the liquid housing body recycling method noted above, it is preferable that at the opening forming step, the forming of the opening part includes forming the opening part on the second sheet member.

With this method, at the opening forming step, the opening part is formed on the second sheet member that is not facing the filter, so damage to the filter accompanying opening formation is reliably suppressed.

With the liquid housing body recycling method noted above, it is preferable that the filter member is detachably attached to the supply member.

With this method, it is possible to set the opening position outside the area facing the filter with the liquid housing unit to a position suitable for injection of the liquid with the injection step.

The liquid housing container for solving the problems noted above includes a case member and a liquid housing body disposed inside the case member, the liquid housing body being recycled by the liquid housing body recycling method noted above.

With this constitution, by equipping the liquid housing body recycled while suppressing damage to the filter, it is possible to repeatedly supply liquid to the liquid consuming device from the same liquid housing container.

BRIEF DESCRIPTION OF THE DRAWINGS

Referring now to the attached drawings which form a part of this original disclosure:

FIGS. 4A and 4B are perspective views seen in a state with the ink bag flipped over;

FIG. 5A is an arrow cross section view of line 5*a*-5*a* in FIG. 4A, and FIG. 5B is an arrow cross section view of line 5*b*-5*b* in FIG. 4B;

FIG. 7A is a drawing of the state with the opening part provided in the bag body, FIG. 7B is a drawing of the state with ink injected from the opening part.

FIGS. 9A and 9B are exploded perspective views of the supply member seen from mutually flipped directions.

DETAILED DESCRIPTION OF EMBODIMENTS

Figure 1:
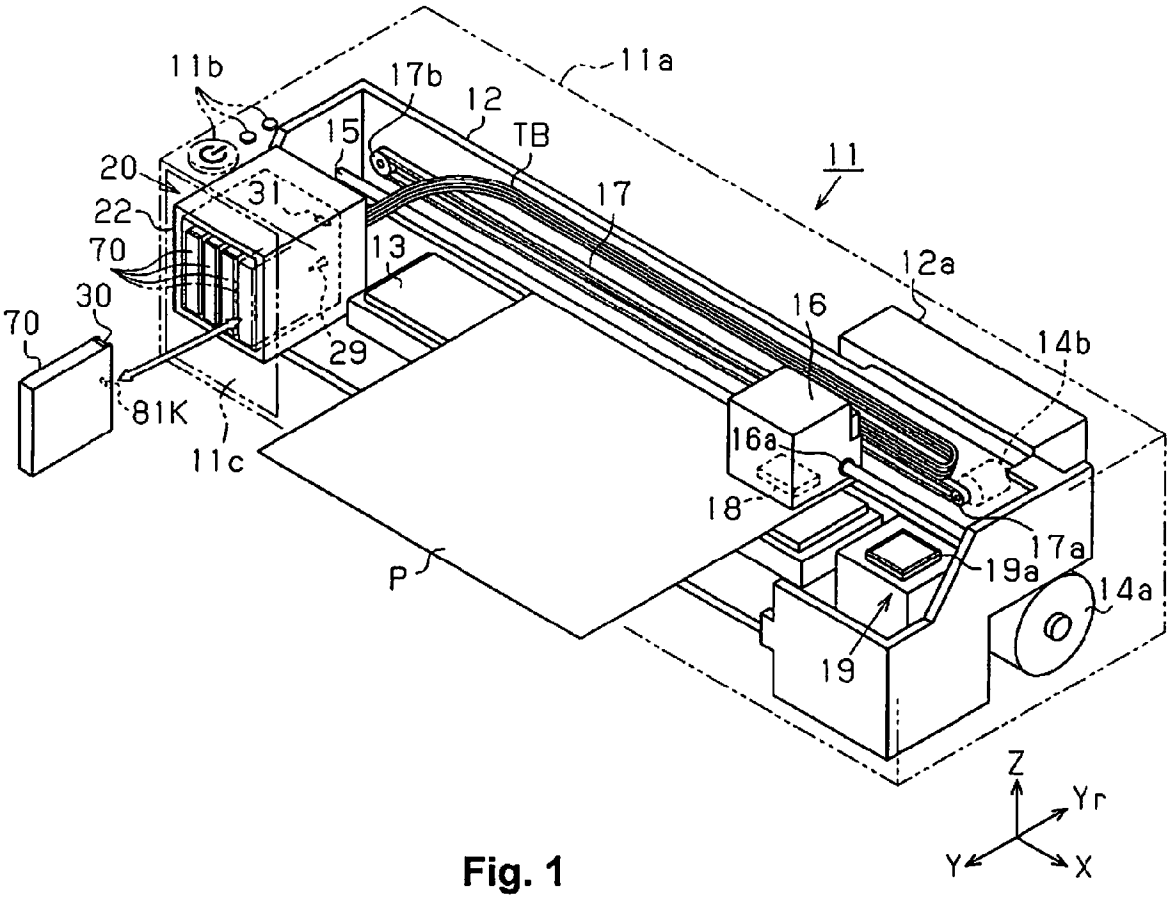
FIG. 1 is a schematic perspective view showing an embodiment of a printer which is an example of a liquid consuming device.

Hereafter, we will describe an embodiment of an inkjet printer which is an example of a liquid consuming device while referring to the drawings. The printer of this embodiment performs printing on a paper P by spraying, specifically, consuming, ink which in an example of a liquid on a paper P conveyed in one direction to form an image.

As shown in FIG. 1, the printer 11 of this embodiment is equipped with a case 11*a* having a roughly rectangular solid shape, a portion of which is shown by a double dot-dash line, and on the top surface of the antigravity direction Z side in the vertical direction, provided is an operating button 11*b* such as a power button or the like for driving the printer 11, and a display unit (not illustrated). Also, an open and closeable cover 11*c* is provided on the front surface of the case 11*a* which is the conveyance direction Y side in which the paper P is conveyed. In a state with this cover 11*c* open, it is possible for the user to attach and detach and replace an ink cartridge 70.

At the bottom part that becomes the gravity direction side inside a frame 12 forming a roughly rectangular box shape housed in an internal space covered by this case 11*a*, a support base 13 which has the direction orthogonal to the paper P conveyance direction Y as the lengthwise direction is provided extending in roughly the horizontal direction, and a paper feed motor 14*a* is provided on the bottom part of the rear side which is the side opposite to the conveyance direction Y. Specifically, through driving of this paper feed motor 14*a*, using a paper feed mechanism (not illustrated), the paper P is fed facing from that rear side to the front side on the support base 13.

Also, upward, which becomes the antigravity direction side of the support base 13 inside the frame 12, a guide shaft 15 is stretched across along the lengthwise direction of the support base 13. A carriage 16 is supported so as to be able to move back and forth in the axis line direction on this guide shaft 15. More specifically, a support hole 16*a* that pierces through in the lateral direction is formed on the carriage 16, and the guide shaft 15 is inserted through this support hole 16*a*.

A driving pulley 17*a* and a driven pulley 17*b* are respectively supported to be able to rotate freely at positions near both ends of the guide shaft 15 noted above on the back wall inner surface of the frame 12. An output shaft of a carriage motor 14*b* is coupled to the driving pulley 17*a*, and a seamless timing belt 17 for which a portion is coupled to the carriage 16 is wound between the driving pulley 17*a* and the driven pulley 17*b*. Also, by the carriage motor 14*b* being driven, while the carriage 16 is guided by the guide shaft 15 via the timing belt 17, it moves back and forth in the lengthwise direction, specifically, along the scanning direction ±X. A liquid spray head 18 which is an example of a liquid spray unit is provided on the bottom side of this carriage 16, and the ink supplied to this liquid spray head 18 is sprayed from the liquid spray head 18 and consumed, and an image is printed on the paper P.

Inside the case 11*a*, at the left side of the scanning direction X seen from the front side, arranged is a mounting unit 20 for which an ink cartridge 70 which is an example of a liquid housing container is mounted so as to be able to be inserted and removed. An ink supply tube TB capable of flowing ink is coupled between the mounting unit 20 and the carriage 16. The ink inside the ink cartridge 70 is supplied to the liquid spray head 18 via this ink supply tube TB.

With this embodiment, the mounting unit 20 has a box shaped cartridge holding body 22 for which the front side is opened. Four roughly rectangular solid ink cartridges 70 are constituted to be able to be mounted aligned along the scanning direction X inside the cartridge holding body 22. Housed in the four ink cartridges 70, for example, are mutually different colors of cyan, magenta, yellow, and black ink. Because of this, on each mounting unit 20 are also equipped four supply needles 29 corresponding to each ink cartridge 70 which are examples of a liquid supply tube. Each ink cartridge 70 can be inserted and removed as shown by the white outline arrow in the mounting unit 20 inside the case 11*a* in a state with the cover 11*c* opened.

Also, by the supply needle 29 being provided in the inner wall of the cartridge holding body 22 of the Yr tip side of the insertion direction of the ink cartridge 70, and the supply port 81K of the inserted ink cartridge 70 and the supply needle 29 being connected, ink is supplied from the ink cartridge 70. Also, the ink supplied to the supply needle 29 is sent to the liquid spray head 18 via the ink supply tube TB from the ink flow path formed on the mounting unit 20 by the operation of a pump (not illustrated) (e.g., a diaphragm pump) equipped in the mounting unit 20. With this embodiment, the insertion direction Yr of the ink cartridge 70 is the opposite direction to the conveyance direction Y of the paper P.

Meanwhile, in the area further to the scanning direction X right side seen from the front side than the support base 13 in the frame 12 interior, specifically, the home position area that is not used during printing, provided is a maintenance device 19 having a box shaped cap with a bottom 19*a* that is opened upward and a suction pump or the like (not illustrated). Also, with the printer 11, after the carriage 16 is moved to the home position area, with this maintenance device 19, a maintenance operation is performed that does maintenance so that ink is sprayed stably from the liquid spray head 18.

The various operations performed by this kind of printer 11 are controlled by a control unit. With this embodiment, the control unit is constituted by a circuit substrate on which are mounted electrical components such as a CPU, RAM, ROM or the like, and for example is arranged inside a case 12*a* equipped to the rear of the frame 12.

Furthermore, when ink is supplied from the ink cartridge 70, the control unit performs communication of designated cartridge information (e.g., data such as ink cartridge 70 identification data or the remaining volume of ink inside the ink cartridge 70 or the like) with memory (not illustrated) which is an example of a storage device equipped in the ink cartridge 70. The cartridge information is updated as appropriate by the control unit. Also, the ink remaining volume data is displayed on a display unit of the case 11*a* as necessary.

This cartridge information communication is specifically performed by an electrical connection between an electrical connection part 31 constituted by terminals or the like equipped in the cartridge holding body 22, and an electrical connection part 30 constituted by a circuit substrate having terminals equipped in the ink cartridge 70. Therefore, four electrical connection parts 31 are equipped according to the number of ink cartridges 70 in the mounting unit 20. In FIG. 1, only one electrical connection part 31 is illustrated.

Figure 2:
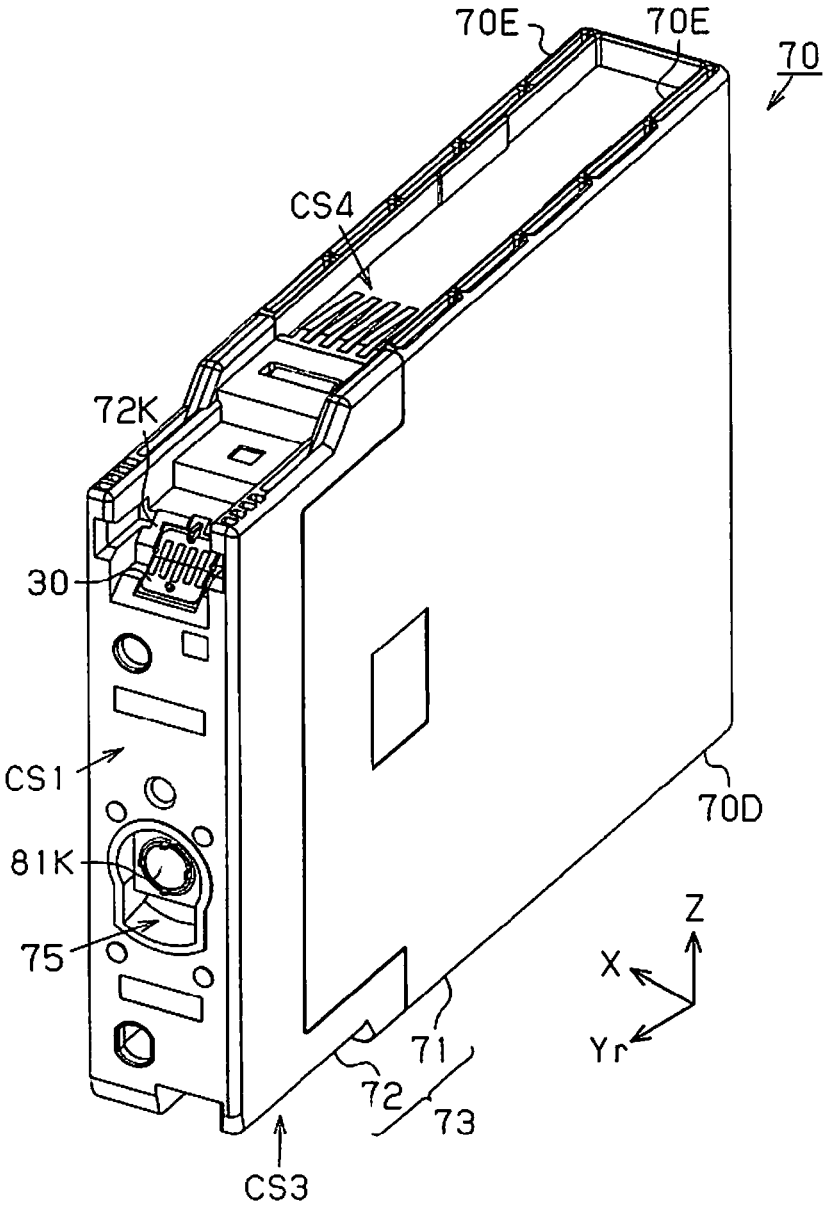
FIG. 2 is a perspective view showing an ink cartridge mounted in a mounting unit of the printer.

As shown in FIG. 2, the ink cartridge 70 of this embodiment has a first case member 71 on the rear side opposite to the lead side of the insertion direction Yr, and a second case member 72 on the lead side of the insertion direction Yr. Also, the supply port 81K of the ink bag 80 is exposed on the concave shaped part 75 provided on the front side surface CS1 of the lead side, specifically, the front side surface CS1 of the second case member 72 during insertion of the ink cartridge 70. Also, an inclined plane 72K is provided on the top end part of the front side surface CS1 on the second case member 72, and the electrical connection part 30 is attached to this inclined plane 72K.

With this embodiment, with the mounting unit 20, a guide rib (not illustrated) is provided at a position corresponding to the inserted ink cartridge 70, and the ink cartridge 70 is inserted while being guided by the guide rib of the mounting unit 20. Specifically, on the top side surface CS4 and the bottom side surface CS3 of the ink cartridge 70, respectively formed are an upper convex part 70E and a lower convex part 70D that extend along the insertion direction Yr at both end parts in the width direction. By this upper convex part 70E and lower convex part 70D being moved while being aligned by respectively abutting the guide ribs provided on the mounting unit 20 in the scanning direction X, the ink cartridges 70 are inserted in set positions with the mounting unit 20. As a result, the supply port 81K is suppressed from having positional skew in relation to the supply needle 29, and is made to be suitably connected to the supply needle 29. Also, the electrical connection part 30 is suppressed from having positional skew in relation to the electrical connection part 31, and is made to be suitably connected to the electrical connection part 31.

Next, we will describe the internal constitution of the ink cartridge 70.

Figure 3:
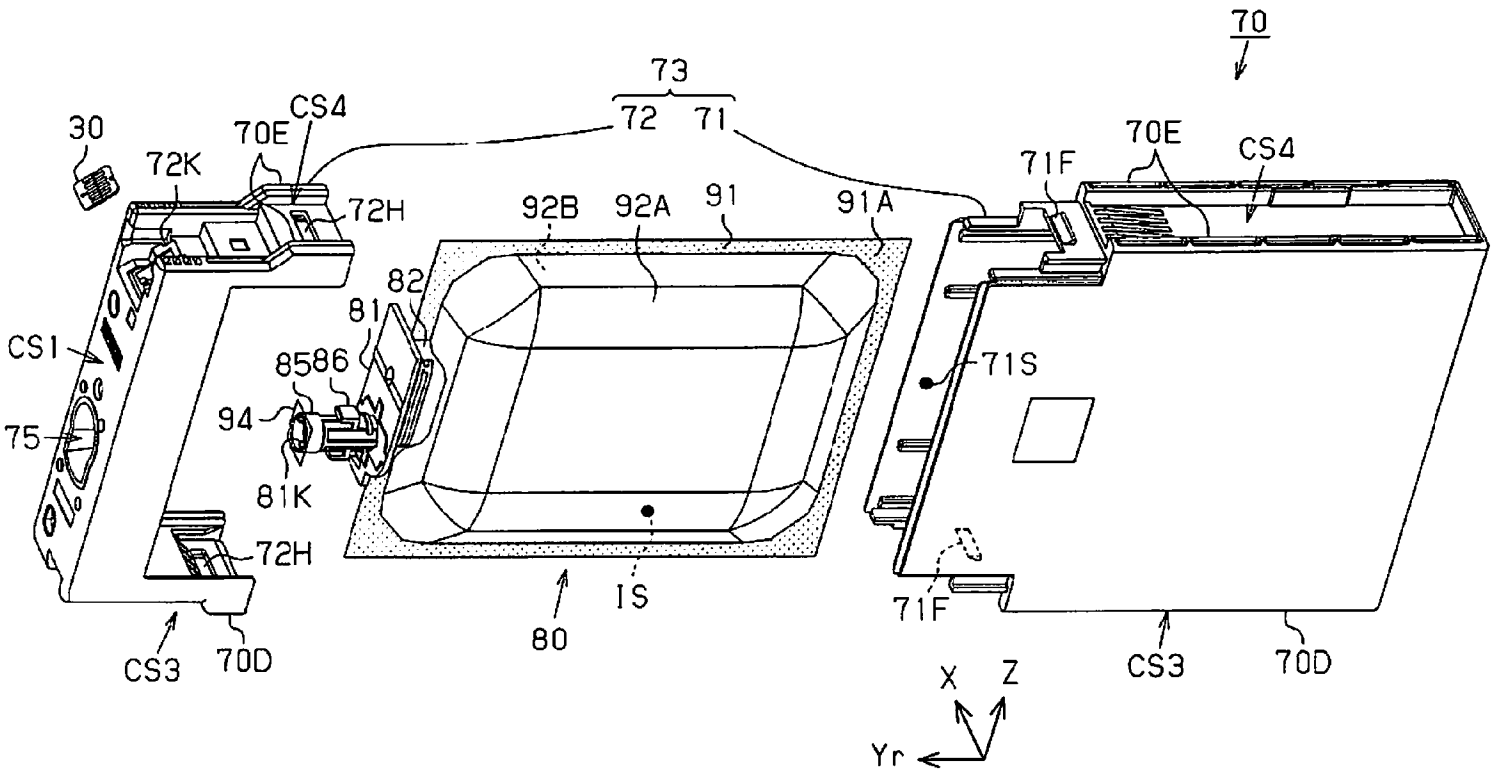
FIG. 3 is an exploded perspective view showing the constitution of the ink cartridge.

As shown in FIG. 3, the ink cartridge 70 has the ink bag 80 as the liquid housing body housed inside the case member 73 for which the two members of the first case member 71 and the second case member 72 are combined. The X, Yr, and Z directions shown in FIG. 3 are the same as the X, Yr, and Z directions of FIG. 1 with the orientation of the ink cartridge 70 mounted in the printer 11.

The first case member 71 has roughly a box shape having an opening area 71S in which the ink bag 80 can be inserted and removed, and roughly triangular prism shaped projecting parts 71F are respectively formed on the bottom side surface CS3 and the top side surface CS4. Meanwhile, on the second case member 72, roughly rectangular hole parts 72H in which the projecting part 71F can be inserted are respectively formed on the bottom side surface CS3 and top side surface CS4. Also, as the second case member 72 is moved so as to cover that opening area 71S on that first case member 71, by the projecting part 71F of the first case member 71 being fit from the inside in the hole part 72H of the second case member 72, the second case member 72 is attached to the first case member 71. Conversely, by pulling the second case member 72 so as to pull away from the first case member 71, the projecting part 71F is taken out from the hole part 72H, and the second case member 72 is removed from the first case member 71.

The ink bag 80 has the opening side of a bag shaped bag body 91 which is an example of the liquid housing unit joined to a junction part 82 of the supply member 81 which has the supply port 81K. Its interior is an ink chamber IS (liquid housing unit) in which ink can be housed. With this embodiment, the bag body 91 is formed using a flexible sheet member, and two sheet form bag members 92A and 92B are first formed into a bag shape with three of the four outer edges adhered. Next, in a state with the junction part 82 of the supply member 81 inserted in the bag opening side formed by the one side that is not adhered, by adhering at one side together with the supply member 81, an adhered part 91A is formed around the periphery of the bag body 91 shown by the shaded area in FIG. 3, and the interior of the bag body 91 is used as the ink chamber IS. Then, the flexible bag body 91 is deformed so as to decrease the gap between the two bag members 92A and 92B facing opposite as the capacity of the ink chamber IS decreased due to an outflow of ink.

With this embodiment, the constitution is such that the supply member 81 having the supply port 81K, specifically, the supply member 81 in which the supply port 81K is provided, is attached to the second case member 72 by rotating relative to the second case member 72. The supply member 81 has a tube shaped flow path part 85 provided that is in communication with the supply port 81K. A pair of parts to be engaged 86 project from the tube shaped flow path part 85. Also, the constitution is such that after the tube shaped flow path part 85 is inserted into a hole (not illustrated) provided in the concave shaped part 75 of the second case member 72, by rotating with its axis line as the center, this is fixed by the part to be engaged 86 provided in the tube shaped flow path part 85 and the concave shaped part 75 as the engaging part provided in the second case member 72 being engaged. By the tube shaped flow path part 85 being fixed to the concave shaped part 75 in this way, the ink bag 80 is attached to the second case member 72.

Next, we will describe the member constitution of the ink bag 80.

Figure 4B:
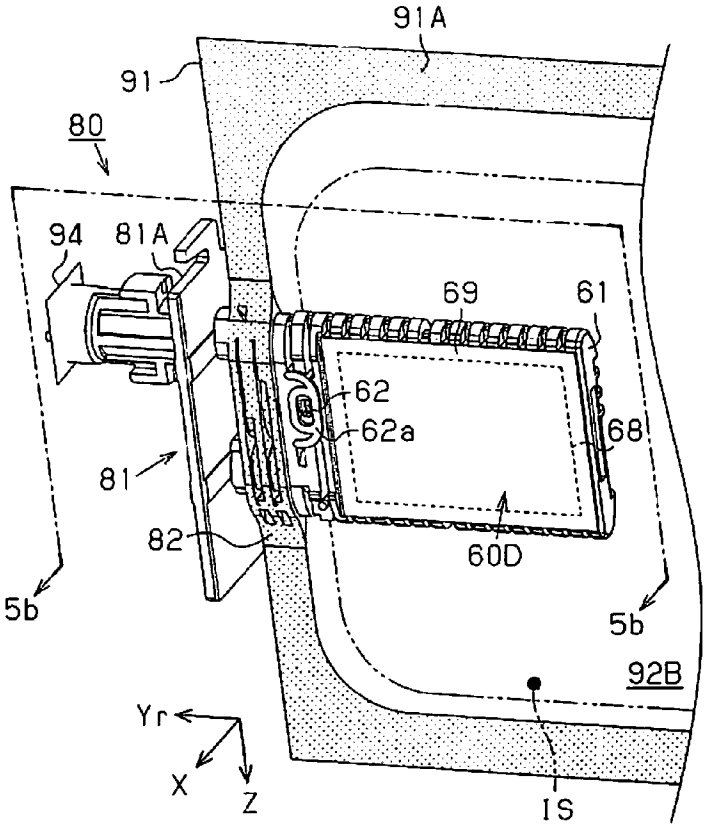
FIGS. 4A and 4B are drawings showing an ink bag equipped inside the ink cartridge, where
Figure 4A:
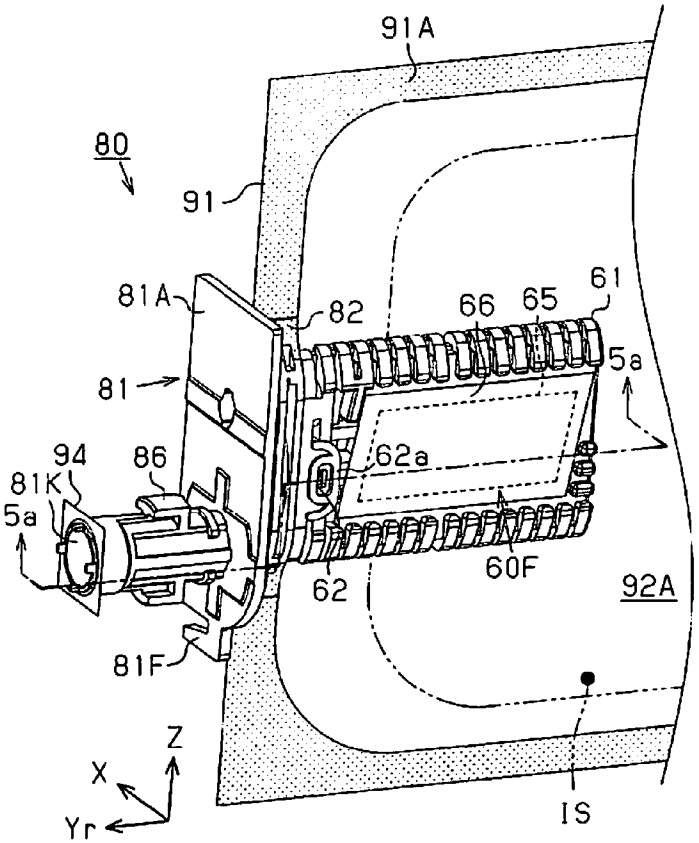

As shown in FIGS. 4A and 4B, the ink bag 80 is equipped with the supply member 81 in which the supply port 81K is provided, and a filter chamber 60F and a de-aerating chamber 60D inside the ink chamber IS inside the bag body 91 joined to the junction part 82 of this supply member 81. The X, Yr, and Z axis directions of FIGS. 4A and 4B are the same as the X, Yr, and Z axes of FIG. 1 in the orientation with the ink cartridge 70 mounted on the printer. Also, FIG. 4B shows the ink bag 80 of FIG. 4A in an inverted state. Also, with FIGS. 4A and 4B, the bag body 91 is shown in a transparent state.

With this embodiment, two spaces for which one end is respectively opened are formed on a connecting member 61 connected to the supply member 81. Also, so as to close a first opening 65 and a second opening 68 which become the openings of the respective spaces, a filter 66 through which ink can pass and a film 69 through which gas can be transmitted are respectively adhered, and a filter 60F and a de-aerating chamber 60D are formed. Therefore, the connecting member 61 is also the filter member to which the filter 66 has been adhered.

The filter 66 and the film 69 are arranged at mutually overlapping positions seen from the width direction of the ink cartridge 70 which is the scanning direction X in a state with the ink cartridge 70 mounted on the mounting unit 20, in other words, at positions for which they have a front and back relationship to each other with the connecting member 61. Also, the bag member 92A is positioned at the side facing the filter 66, and the bag member 92B is positioned at the side facing the film 69. Also, the filter 66 is in sheet form, and its sheet surface is positioned in an orientation in a direction along the sheet surface of the bag member 92A in a state for which ink is not housed inside the bag body 91, either before ink is housed, or after the housed ink is flowed out. Meanwhile, the film surface of the film 69 is arranged in an orientation in the direction along the sheet surface of the bag member 92B in a state for which the ink is not housed inside the bag body 91, in the same manner, either before the ink is housed, or after the housed ink is flowed out.

Therefore, the area for which the filter 66 and the bag member 92A overlap in a state with the housed ink consumed during manufacturing of the ink cartridge 70, and the capacity of the ink chamber IS is reduced so that ink is not housed inside the bag body 91, is an area for which the filter 66 and the bag body 91 face opposite each other. Similarly, the area for which the film 69 and the bag member 92B face opposite is an area where they overlap each other. Also, at least the bag member 92A as the first sheet member has its sheet surface parallel to the sheet surface of the filter 66 in a state in which ink is not housed inside the bag body 91. Therefore, with the bag member 92A, the area overlapping the filter 66 can be easily visually confirmed. Parallel as mentioned here includes a slight angle difference due to deformation, bending or the like of the bag member 92A, for example.

Also, with this embodiment, in a state for which ink is not housed inside the bag body 91 after housed ink is flowed out, the bag member 92A is deformed to the degree that it is possible to distinguish the outline shape of the connecting member 61. Also, the bag member 92B is also deformed to the level that it is possible to distinguish the outline shape of the connecting member 61.

Also, an injection port 62 for when first injecting ink into the ink chamber IS is provided on the connecting member 61, and after ink is injected, the injection port 62 is sealed so as to block communication with the ink chamber IS by joining (adhering) bag members 92A and 92B on a ring shaped rib 62*a* provided so as to enclose this injection port 62.

Figure 5A:
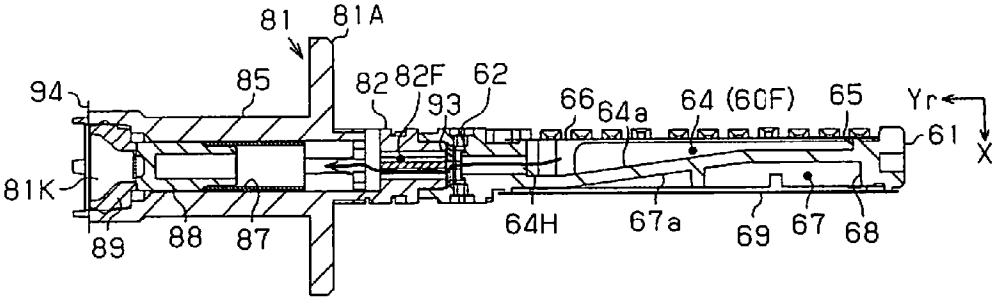
FIGS. 5A and 5B are drawings showing an ink supply flow path provided in the supply member, where
Figure 5B:
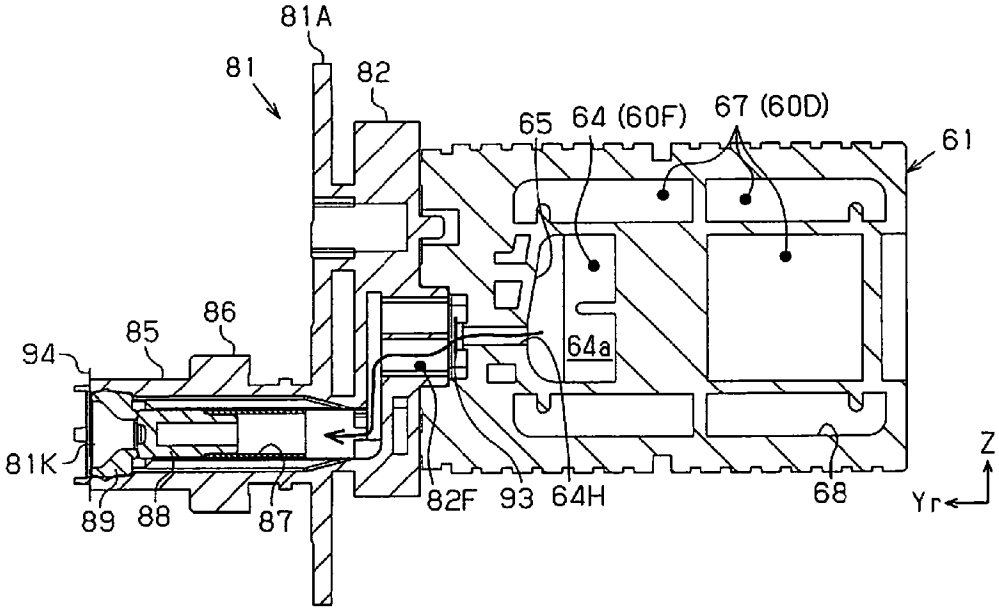

Next, we will describe the supply member 81 and the connecting member 61 while referring to FIGS. 4A and 4B and FIGS. 5A and 5B. With FIGS. 5A and 5B, the bag body 91 is omitted, and the supply member 81 and the connecting member 61 are illustrated. Also, the X, Yr, and Z axis directions of FIGS. 5A and 5B are the same as the X, Yr, and Z axes of FIG. 1 in an orientation with the ink cartridge 70 mounted in the printer.

As shown in FIGS. 5A and 5B, the connecting member 61 of this embodiment is attached to the supply member 81 by adhering or fitting while sandwiching a valve body 93 (non-return valve), and becomes an integral unit with the supply member 81. Also, the part adjacent to the connecting member 61 of the supply member 81 is the junction part 82 for which the bag body 91 is joined by adhesion or the like as shown in FIG. 4B. The connecting member 61 has an outline that is roughly a rectangular solid shape.

Also, as shown in FIG. 4A, the supply member 81 has a main unit 81A that is roughly a rectangular plate shape on the insertion direction Yr side to the mounting unit 20 with this junction part 82. One end of the lengthwise direction of the main unit 81A is rectangular whereas the other end has a roughly L shaped L part 81F formed. The tube shaped flow path part 85 is provided projecting at a position toward the edge of the L part 81F of the main unit 81A on the main unit 81A of the supply member 81.

A first recess area 64 having a first opening 65 that is roughly parallelogram shaped is provided on the connecting member 61. Also, so as to close the first opening 65 of this first recess area 64, by the filter 66 for suppressing passing through (transmission) of foreign matter other than ink so as to allow passing through of ink by transmitting it being adhered to the connecting member 61, the filter chamber 60F is formed.

Also, an inclined plane 64*a* with the tip downward facing the supply member 81 side is formed on the bottom surface of the first recess area 64 in the filter chamber 60F. Also, an ink outflow port 64H for flowing out ink that has passed through the filter 66 to the supply member 81 from the connecting member 61 is provided on the supply member 81 side of the first recess area 64. Therefore, the ink housed in the ink chamber IS is flowed into the filter chamber 60F after passing through the filter 66, and is further flowed via the ink outflow port 64H to the supply port 81K positioned at the tip of the tube shaped flow path part 85 provided on the supply member 81.

Specifically, as shown by the solid line arrow in FIGS. 5A and 5B, the ink that flows into the filter chamber 60F after passing through the filter 66 from the ink chamber IS, after flowing into the ink outflow port 64H, passes through the valve body 93 and flows in the supply flow path 82F provided in the supply member 81, and flows inside the tube shaped flow path part 85 in communication with this supply flow path 82F. In this way, the ink inside the ink chamber IS is led up to the supply port 81K via the supply flow path 82F formed on the supply member 81 after passing through the filter 66. The valve body 93 allows the flow of ink from the ink chamber IS side to the supply port 81K side, and functions as a non-return valve restricting backflow of ink from the supply port 81K side to the ink chamber IS side.

On the tube shaped flow path part 85, as shown in FIGS. 5A and 5B, in sequence from the supply port 81K side, a supply port spring 87, a supply port spring seat 88, and a supply port sealing rubber 89 are inserted, and finally, the supply port film 94 is joined by adhesion or the like to the tip of the tube shaped flow path part 85. By this joining of the supply port film 94, the supply port 81K is in a sealed state. Then, the supply port film 94 seal is broken by the supply needle 29 being inserted in the supply port 81K formed at the tip of the tube shaped flow path part 85, and the supply port spring seat 88 that was abutting the supply port sealing rubber 89 and blocking the ink flow path is pushed in so as to separate from the supply port sealing rubber 89. As a result, at the supply port 81K, a gap is formed for which ink can flow by inserting the supply needle 29, and ink flows into the supply needle 29 that was inserted from the formed gap.

Also, with this embodiment, the first recess area 64 that becomes the filter chamber 60F and the filter 66 are arranged in overlapping positions with the supply port 81K seen from the axis line direction of the tube shaped flow path part 85 on the connecting member 61.

Furthermore, with this embodiment, on the connecting member 61, a second recess area 67 having the roughly rectangular second opening 68 on the side opposite the first opening 65 is provided so as to overlap the first recess area 64. On this second recess area 67, an inclined plane 67*a* with the tip upward approaching the second opening 68 facing the supply member 81 side is provided at a position almost overlapping the inclined plane 64*a* of the first recess area 64. Also, the film 69 through which gas that was dissolved in the ink or air bubbles generated in the ink can pass is adhered to the connecting member 61 so as to close the second opening 68 in a reduced pressure atmosphere, and the second recess area 67 is a sealed space having lower pressure than atmospheric pressure. In this way, the second recess area 67 constitutes the de-aerating chamber 60D.

Figure 6:
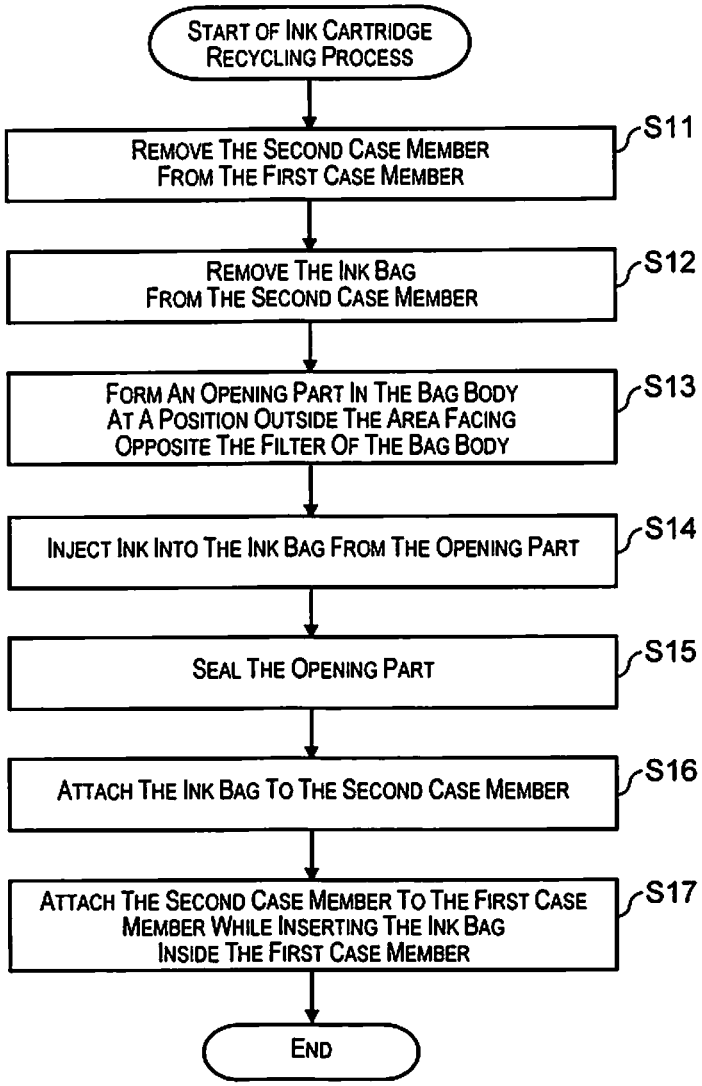
FIG. 6 is a flow chart showing the ink cartridge recycling processing method.

Next, while referring to FIG. 6, we will describe the action of recycling by re-injecting ink into the ink bag 80 with the ink cartridge 70 of this embodiment, specifically, the ink cartridge recycling process. This process is performed on ink cartridges 70 determined to have run out of ink based on the cartridge information of the ink cartridge 70. For example, it may be performed by the collector who collected the ink cartridge 70 that ran out of ink. The collector can also be the printer manufacturer.

As shown in FIG. 6, with this process of recycling ink bag cartridges, first, at step S11, the process of removing the second case member 72 from the first case member 71 is performed. The collector takes out the ink cartridge 70 subject to recycling from the mounting unit 20 of the printer 11, and then pulls out and removes the second case member 72 from the first case member 71. At this time, with this embodiment, the ink bag 80 is attached to the second case member 72, so as the second case member 72 is being pulled out, the ink bag 80 is being taken out from the opening area 71S of the first case member 71.

Next, at step S12, the process of removing the ink bag from the second case member 72 is performed. In specific terms, the engagement of the part to be engaged 86 formed on the tube shaped flow path part 85 of the ink bag 80 and the concave shaped part 75 is released by rotating the ink bag 80 in relation to the second case member 72, for example, and the ink bag 80 is removed from the second case member 72.

Next, at step S13, processing is performed to form the opening part 92H on the bag body 91 (opening forming step) at the position outside the area facing the filter 66 of the bag body 91. Subsequently, at step S14, the process is performed of injecting ink from the formed opening part 92H into the ink bag 80 (bag body 91) (injection step). Then, at the next step S15, the process of sealing the opening part 92H is performed (sealing step).

Figure 7C:
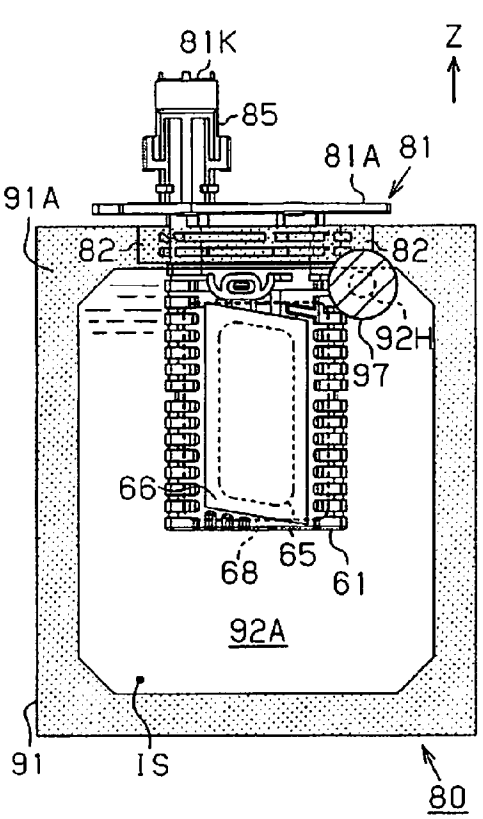
FIG. 7C is a drawing of the state with the opening part sealed after injection.
Figure 7B:
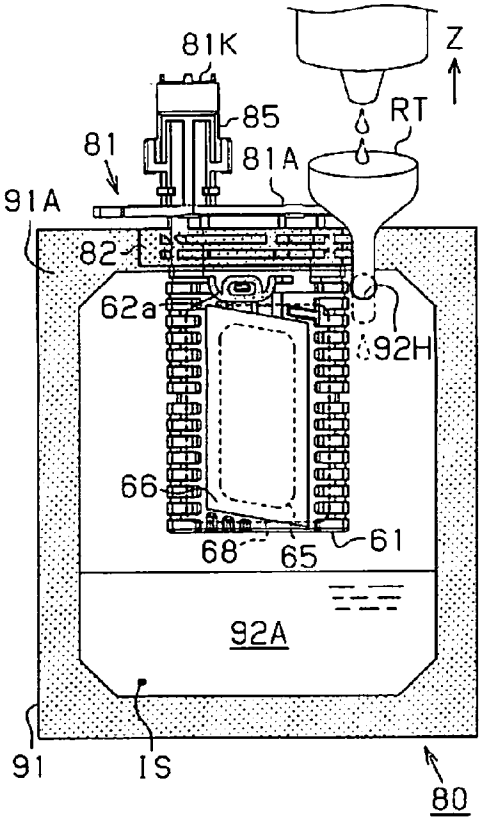
FIGS. 7A and 7B are drawings showing the ink bag, where
Figure 7A:
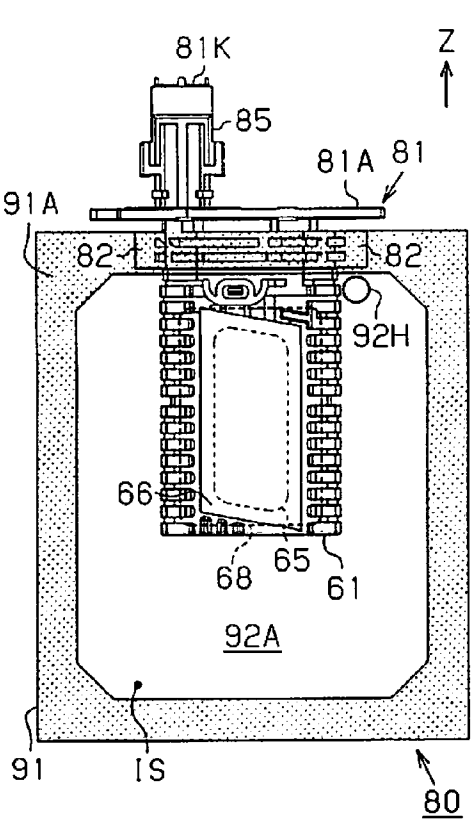

FIGS. 7A to 7C show examples of the processes from step S13 to step S15.

As shown in FIG. 7A, with this embodiment, so that ink does not leak from the supply port 81K for which the supply port film 94 has been torn during injection of the ink, the ink bag 80 is in a state for which the supply port 81K faces the antigravity direction Z side. Also, with the bag member 92A, at the ink chamber IS antigravity direction Z side end part, at a position outside the area for which there is overlap with the filter 66 assumed from the deformation status (opposite facing area), the opening part 92H having a designated diameter dimension is formed at a position near the connecting member 61. Specifically, with the bag body 91 in a state for which the housed ink has decreased, there is a high probability that a structural gap will be formed between the bag member 92A and the bag member 92B positioned near the connecting member 61. Therefore, when forming the opening part 92H at a position near the connecting member 61 in this way, for example when opening a hole in the bag member 92A using an end mill, there is a low probability of the tip of the end mill reaching as far as the bag member 92B positioned at the opposite side, so it is possible to form the opening part 92H on one bag member 92A side.

Subsequently, as shown in FIG. 7B, in a state with the ink bag 80 having the supply port 81K facing the antigravity direction Z side, ink from the formed opening part 92H is injected into the ink chamber IS inside the bag body 91 (refilled). At this time, it is preferable to use a tool to make the injection work easy. Here, a funnel RT is used as a tool, and its thin tube side is inserted in the opening part 92H. Also, when injecting ink, it is possible to pressurize the ink.

The opening part 92H is formed at a position separated in relation to the welded part of the ring shaped rib 62*a* shown with shading provided so as to enclose the injection port 72 in which ink is injected during manufacturing of the ink cartridge 70. Therefore, even if the bag member 92A is deformed during ink injection work, having the adhered part of the ring shaped rib 62*a* peeled off so that the bag member 92A is torn is suppressed.

Subsequently, as shown in FIG. 7C, in a state with the ink bag 80 having the supply port 81K facing the antigravity direction Z side, after injecting ink into the bag body 91 and refilling, by the collector adhering the designated sealing film 97 to the bag member 92A using an adhesive agent or the like so as to cover the opening part 92H, sealing is done so that ink does not leak from the opening part 92H. Alternatively, it is also possible to seal the opening part 92H by adhering a sealing material such as an adhesive agent or the like rather than the sealing film. Of course, it is preferable to seal the opening part 92H in a state with the ink overflowing from the opening part 92H so that gas (air) does not enter (does not remain) inside the ink chamber IS.

Returning to FIG. 6, next, at step S16, the process of attaching the ink bag 80 to the second case member 72 is performed. Here, after the collector inserts the tube shaped flow path part 85 of the ink bag 80 in which ink has been injected again into a hole provided in the concave shaped part 75 of the second case member 72, the supply member 81 is rotated, and the tube shaped flow path part 85 is fixed and attached at the concave shaped part 75.

Subsequently, at step S17, the process of attaching the second case member 72 to the first case member 71 is performed while inserting the ink bag 80 inside the first case member 71. Here, the collector inserts the ink bag 80 from the opening area 71S into the first case member 71, and moves the second case member 72 by sliding to approach the first case member 71. By this sliding movement, by the projecting part 71F of the first case member 71 being fit into the hole part 72H of the second case member 72, the second case member 72 is attached to the first case member 71, and recycling processing of the ink cartridge 70 ends.

With the embodiment described above, it is possible to obtain the following effects.

(1) The opening part 92H for injecting ink inside the bag body 91 of the ink bag 80 during recycling is formed outside the area facing opposite the filter 66 with the bag body 91, so it is possible to recycle the ink bag 80 while suppressing damage to the filter 66 that the ink bag 80 has. Also, by having the ink bag 80 recycled while suppressing damage to the filter 66, it is possible to repeatedly supply ink from the same ink cartridge 70 to the printer 11.

(2) It is possible to easily confirm from the deformation situation of the bag member 92A the area of the bag body 91 for which it is possible to do opening formation of the opening part 92H outside the area overlapping the filter 66 in a state without ink housed, in other words, outside the area facing opposite the filter 66, so at step S13, it is possible to form the opening part 92H while suppressing damage to the filter 66 with high probability.

(3) It is easy to visually check the area for which an opening is possible outside the area facing opposite the filter 66 with the bag member 92A in a state with ink not housed inside the bag body 91. Therefore, at step S13, it is possible to easily form the opening part 92H on the bag member 92A while suppressing damage to the filter.

The embodiment noted above can also be modified to other embodiments such as those noted below.

With the recycling process of the ink cartridge 70 of the embodiment noted above, at step S13, it is also possible to form the opening part 92H on the bag member 92B not facing the filter 66.

Figure 8:
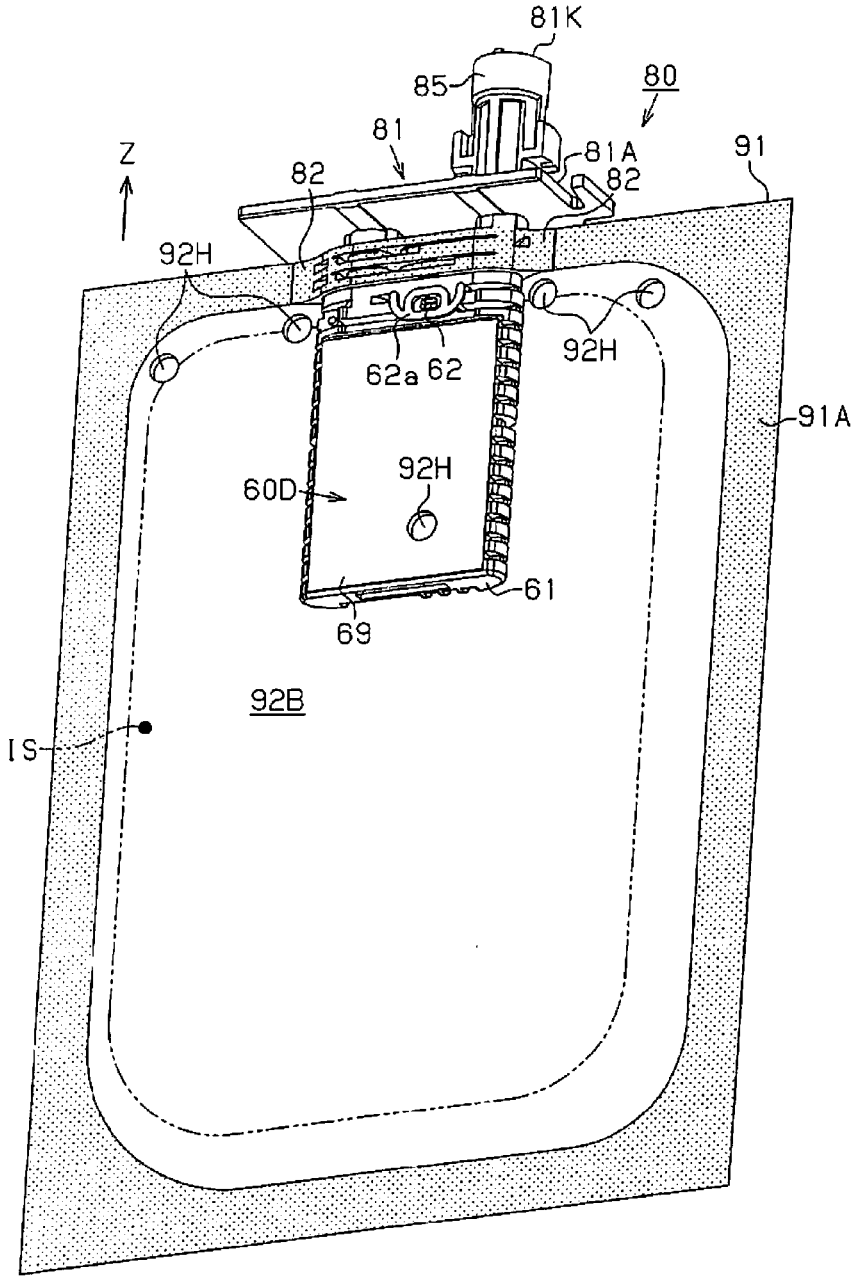
FIG. 8 is a perspective view of the ink bag formed on the bag body on the side for which the opening part does not face the filter.

As shown in FIG. 8, with this modification example, the opening part 92H is formed at the supply member 81 side end part in the ink chamber IS, which is an area that does not overlap with the connecting member 61. By doing this, when ink is injected with the supply port 81K at the antigravity direction Z side, there is a higher probability of being able to inject ink at a volume that will fill the inside of the ink chamber IS in a state without gas being included inside the ink chamber IS.

Alternatively, it is also possible to form the opening part 92H in the area overlapping the connecting member 61 (the film 69) inside the bag body 91. By doing this, when forming the opening part 92H using an end mill on the bag member 92B, it is possible to use the connecting member 61 to control so as not to have the tip of the end mill reach the filter 66 (filter chamber 60F).

With this modification example, in addition to the effects (1) and (2) of the embodiment noted above, the following effect is exhibited.

(4) At step S13, the opening part 92H is formed on the bag member 92B not facing the filter 66, so damage to the filter 66 accompanying opening formation is reliably suppressed.

With the embodiment noted above, the connecting member 61 which is also the filter member attached so as to be an integral unit with the supply member 81 is preferably equipped so as to be detachable with the supply member 81.

Figure 9A:
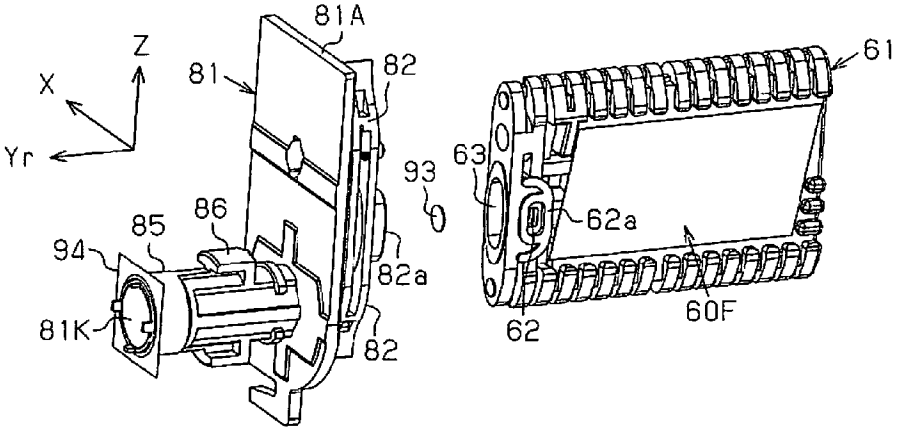
FIGS. 9A and 9B are drawings showing the constitution for which it is possible for the filter member to be attached to the supply member, where
Figure 9B:
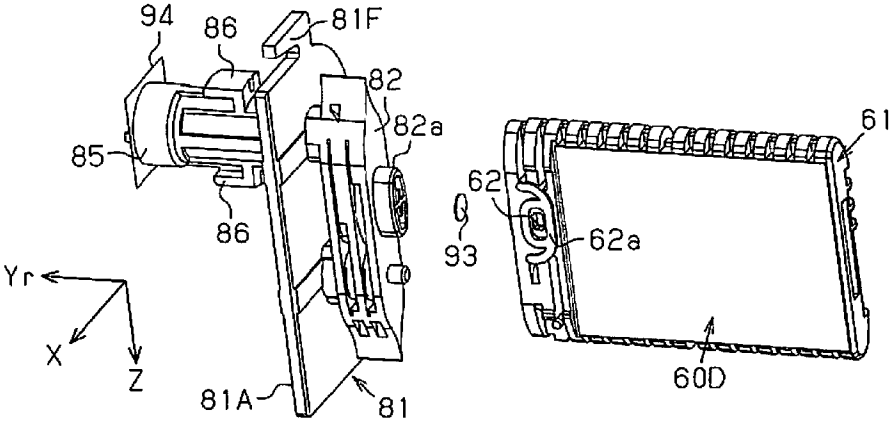

As shown as an example in FIGS. 9A and 9B, with this modification example, for example, on the supply member 81, a connecting part 82*a* having a roughly oval cross section pillar shape is formed projecting on the junction part 82. Also, a part to be connected 63 which is a hole similarly with a roughly oval shaped cross section is formed on the connecting member 61. Also, sandwiching the valve body 93 (non-return valve), the connecting part 82*a* of the supply member 81 is inserted in a state fit into the part to be connected 63 of the connecting member 61, and thus it is possible to attach the connecting member 61 to be an integral unit with the supply member 81. Meanwhile, in a state with the supply member 81 and the connecting member 61 as an integrated unit, for example, by pulling with a designated force so as to pull the connecting member 61 away from the supply member 81, it is possible to cut apart the supply member 81 and the connecting member 61.

Figure 10:
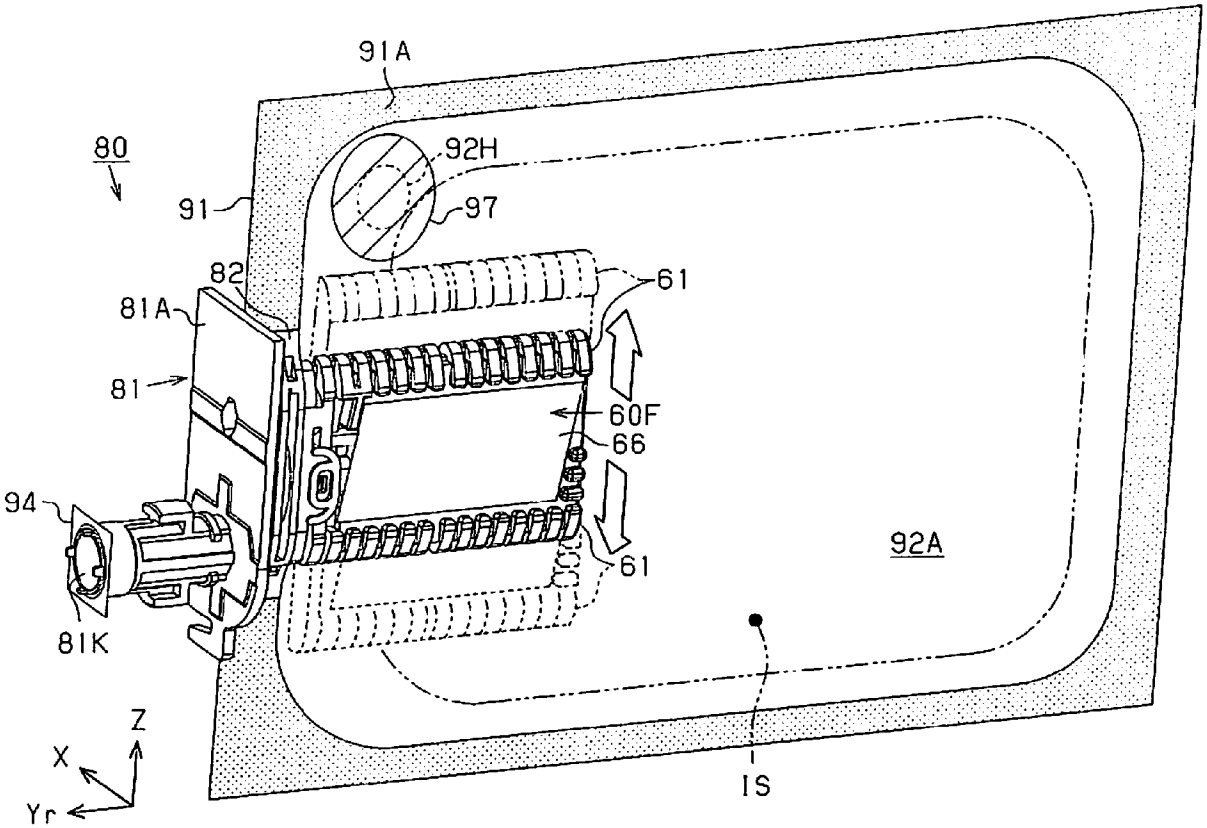
FIG. 10 is a perspective view showing the ink bag for which the position of the filter can be changed.

Therefore, as shown in FIG. 10, by moving and changing at least one of the formation position of the connecting part 82*a* of the supply member 81 side and the formation position of the part to be connected 63 of the connecting member 61 side, it is possible to change the position of the connecting member 61 with the ink chamber IS inside the bag body 91 as shown by the broken line and double dot-dash line in FIG. 10. Specifically, it is possible to move the position of the filter 66 facing the bag member 92A inside the ink chamber IS.

For example, with the ink bag 80, when forming the opening part 92H at the antigravity direction Z side in a state mounted on the mounting unit 20, the connecting member 61 is moved to the gravity direction side shown by the dotted line in FIG. 10 such that the filter 66 separates from the opening part 92H. Also, even when forming the opening part 92H on the bag member 92B side as with the modification example noted above, including when forming the opening part 92H at a position overlapping the connecting member 61, it is preferable to move the connecting member 61 according to the position at which the opening part 92H is formed.

With this modification example, in addition to the effects (1) through (3) of the embodiment noted above and the effect (4) of the modification example noted above, the following effect is exhibited.

(5) With the bag body 91, it is possible to set the opening position outside the area facing opposite the filter 66 to a position suitable for injection of the ink.

With the embodiment noted above, when the formation position of the opening part 92H is not buffered with the second case member 72, it is acceptable to omit the processes of step S12 and step S16 shown in FIG. 6. In this case, the work load of the collector removing the ink bag 80 from the second case member 72, and the work load of attaching the ink bag 80 to the second case member 72 after formation of the opening part 92H is reduced.

With the embodiment noted above, the bag member 92A which is a sheet member does not absolutely have to have the sheet surface area be at a maximum in a state with ink not housed inside the bag body 91. For example, in a case such as when constituting the bag body 91 with a plurality of bag members of three or more, the bag member 92A facing (facing opposite) the filter 66 may have times when it has a smaller surface area than the other bag member (bag member 92B) in a state when ink is not housed inside the bag body 91. In such a case as well, it is possible to form the opening part 92H on the bag member 92A.

With the embodiment noted above, the filter 66 does not absolutely have to be arranged inside the bag body 91 in an orientation with the sheet surface in a direction along the sheet surface of the bag body 91 (bag member 92A) in a state with ink not housed inside the bag body 91. For example, the filter 66 can also be arranged in a direction crossing the sheet surface of the bag member 92A.

In this case, the area in which the filter 66 and the bag body 91 face opposite each other is the area for which the filter 66 and the bag body 91 overlap seen from the perpendicular line direction of the sheet surface of the bag member 92A. Or it is the area for which the filter 66 and the bag body 91 overlap seen from the perpendicular line direction of the sheet surface of the filter 66. Alternatively, it is both of these.

With the embodiment noted above, the bag body 91 does not absolutely have to be a sheet member. For example, it can also be a plate member with little deformation. In this case, regardless of whether or not the ink is housed inside the bag body 91, the area in which the filter 66 and the bag body 91 face opposite each other is the area for which the filter 66 and the bag body 91 overlap seen from the perpendicular direction of the sheet surface of the filter 66.

With the embodiment noted above, when forming the opening part 92H on the bag member 92A, as long as it is at a position for which it does not overlap the first opening 65 of the filter chamber 60F, the opening part 92H can be formed at a position that overlaps the connecting member 61. With this method, the ink bag 80 can maintain the function of the filter chamber 60F even if the filter 66 is damaged, and it is possible to suppress the formation of the opening part 92H simultaneously on the bag member 92B by the interposed connecting member 61.

With the embodiment noted above, though omitted from the drawing, the opening part 92H can be formed at the side opposite to the supply member 81 in the ink chamber IS. For example, when it is not necessary to inject ink with the supply port 81K on the antigravity direction Z side without ink leaking from the supply port 81K, it is possible to form the opening part 92H in this way.

With the embodiment noted above, the bag body 91 can also be formed with a plurality of bag members of three or more. For example, it is also possible to form it with four bag members with two bag members added as the gusset part that connects between the bag member 92A and the bag member 92B. In this case, the bag member 92A functions as the first sheet member, and the other bag members function as the second sheet members.

With the embodiment noted above, it is not absolutely necessary to form the de-aerating chamber 60D. When there is a low probability of gas being contained in the ink, the de-aerating chamber 60D is not necessary. In this case, for example, it is not necessary to provide the second recess area 67 in the connecting member 61. Alternatively, the de-aerating chamber 60D can also have a constitution such that even if the second recess area 67 is provided, the film 69 is not adhered at the second opening 68.

With the ink cartridge 70 of the embodiment noted above, it is not absolutely necessary to equip the electrical connection part 30. Also, the circuit substrate as the electrical connection part 30 does not absolutely have to be inclined in the insertion direction Yr to the mounting unit 20. For example, it is also possible to use the direction orthogonal to the insertion direction Yr.

With the embodiment noted above, the mounting unit 20 can also have a constitution equipped on the outside of the case 11*a* of the printer 11. When supplying ink to the liquid spray head 18 on the interior of the case 11*a* from the mounting unit 20 provided on the outside of the case 11*a*, it is necessary to lead the ink supply tube TB for supplying ink from the outside of the case 11*a* to the inside. Thus, in this case, it is preferable to provide a hole or notch in the case 11*a* in which the ink supply tube TB can be inserted. Alternatively, it is also possible to lead the ink supply tube TB through the gap provided in the case 11*a* from outside to inside the case 11*a*. By doing this, it is possible to easily perform supplying of ink to the liquid spray head 18 using the ink flow path of the ink supply tube TB.

The liquid spray head 18 is not limited to being a so-called serial head type that sprays ink by moving back and forth together with the carriage 16 in the direction crossing the conveyance direction of the paper P. Specifically, it has an overall shape for which the length size corresponds to the width size of the paper P, and in a state with the lengthwise direction fixed and arranged to go along the width direction that crosses the conveyance direction Y of the paper P, it is also possible to have an item of a so-called line head type that sprays liquid toward the medium from a plurality of nozzles provided so as to extend across roughly the entirety in the lengthwise direction.

With the embodiment noted above, the printer 11 can also be a liquid consuming device that sprays or discharges liquid other than ink. The state of the liquid discharged as tiny droplets from the liquid consuming device includes granular shapes, tear shapes, and threadlike shapes with a tail. What is referred to here as a liquid is acceptable as long as it is a material that can be sprayed by the printing device. For example, a substance when it is in a liquid state such as liquid state materials of high or low viscosity, as well as fluid bodies such as sol, gel water, other inorganic solvents, organic solvents, solutions, liquid resin, liquid metal (metal melt), and the like are included. Also, this is not limited to liquids as one physical property state, but items for which particles of functional materials consisting of a solid such as a pigment, metal particles or the like are dissolved, dispersed, or blended in a solvent and the like are also included. Representative examples of liquid or liquid body printing materials include the kind of ink like that described with the embodiments noted above, liquid crystal and the like. Here, ink includes various types of liquid body compositions such as typical water based inks and oil based inks as well as gel inks, hot melt inks and the like. As a specific example of a liquid consuming device, for example, there are liquid consuming devices which spray liquid including materials such as electrode materials or coloring materials or the like in a dispersed or dissolved form used in manufacturing items such as liquid crystal displays, EL (electro luminescence) displays, surface light emitting displays, color filters and the like. It is also possible to be a liquid consuming device for spraying bioorganic material used for biochip manufacturing, a liquid consuming device for spraying a liquid that will be a sample used for a precision pipette, a textile printing device, a micro dispenser or the like. Furthermore, it is also possible to use a liquid consuming device for spraying lubricating oil with a pinpoint on precision machines such as watches, cameras or the like, or a liquid consuming device for spraying a transparent resin liquid such a ultraviolet curing resin or the like for forming a miniature hemispheric lens (optical lens) used for optical communication elements or the like on a substrate. It can also be a liquid consuming device for spraying an acid or alkaline or the like etching fluid for etching a substrate or the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least t 5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A liquid housing body recycling method for a liquid housing body that includes a liquid housing unit that is configured to house liquid, a supply member with a supply port that is configured to be connected to a liquid supply tube of a liquid consuming device, and a filter through which the liquid is configured to pass, the liquid housing unit being formed of a flexible sheet member, with the liquid inside the liquid housing unit being supplied to the liquid consuming device via the supply port by passing through the filter, the liquid housing body recycling method comprising:

forming an opening part on the sheet member at a position outside an area facing opposite the filter on the liquid housing unit;

injecting the liquid from the opening part of the sheet member on which the opening part has been formed; and sealing the opening part.

2. The liquid housing body recycling method according to claim 1, wherein the filter is in sheet form, and in a state with the liquid not housed inside the liquid housing unit, a sheet surface of the filter is arranged inside the liquid housing unit in an orientation extending along a sheet surface of the liquid housing unit.

3. The liquid housing body recycling method according to claim 2, wherein the liquid housing body further includes a filter member to which the filter is adhered on one surface side and is disposed inside the liquid housing unit, the liquid housing unit has a first sheet member facing the filter adhered to the filter member, and a second sheet member that does not face the filter, and the first sheet member is arranged in parallel to the filter in a state with the liquid not housed inside the liquid housing unit.

4. The liquid housing body recycling method according to claim 3, wherein the forming of the opening part includes forming the opening part on the second sheet member.

5. The liquid housing body recycling method according to claim 3, wherein the filter member is detachably attached to the supply member.

6. A liquid housing container comprising:

a case member; and a liquid housing body disposed inside the case member, the liquid housing body being recycled by the liquid housing body recycling method according to claim 1.

* * * * *